US007712338B2

(12) United States Patent
Tanaka et al.

(10) Patent No.: US 7,712,338 B2
(45) Date of Patent: May 11, 2010

(54) ELECTRIC WASHING MACHINE

(75) Inventors: Hiroyuki Tanaka, Moriguchi (JP); Yoshikazu Banba, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 348 days.

(21) Appl. No.: 12/000,387

(22) Filed: Dec. 12, 2007

(65) Prior Publication Data

US 2008/0178638 A1 Jul. 31, 2008

(30) Foreign Application Priority Data

Jan. 25, 2007 (JP) ..... 2007-015361

(51) Int. Cl.
*D06F 39/14* (2006.01)

(52) U.S. Cl. ..... 68/212

(58) Field of Classification Search ..... 68/212
See application file for complete search history.

(56) References Cited

U.S. PATENT DOCUMENTS 2,728,481 A * 12/1955 Robinson et al. ..... 220/4.02
5,761,933 A * 6/1998 Kim et al. ..... 68/23.2
2003/0041629 A1* 3/2003 Wright ..... 68/139
2004/0168382 A1* 9/2004 Rudduck et al. ..... 52/238.1
2005/0262883 A1 12/2005 Yang et al.
2006/0117596 A1* 6/2006 Kim et al. ..... 34/607

FOREIGN PATENT DOCUMENTS

JP 2005-334636 12/2005

* cited by examiner

*Primary Examiner*—Frankie L Stinson
*Assistant Examiner*—Samuel A Waldbaum
(74) *Attorney, Agent, or Firm*—Rabin & Berdo, PC

(57) ABSTRACT

An inventive electric washing machine is configured so that a gas to be used for performing a specific process (decontamination process) on laundry is prevented from leaking to the outside. In the electric washing machine, a packing (120) to be brought into intimate contact with a door (12) for sealing a gap defined between the door (12) and a peripheral edge of an outer tub opening (118) when the door (12) is closed is opposed to a housing opening (14) with a space (129) defined between a lower edge portion of the housing opening (14) and the packing (120). If the door (12) is closed with laundry protruding through the lower edge portion of the housing opening (14), the protruding laundry is caught between the door (12) and the packing (120), so that the packing (120) is not brought into intimate contact with the door (12). If ozone is supplied into an outer tub (21) in this state, the ozone flows toward the housing opening (14) through a gap between the door (12) and the packing (120) at which the laundry is caught. However, the ozone flows into the space (129) (as indicated by a broken-line arrow X) and is retained in a housing (11) to be thereby prevented from leaking to the outside.

9 Claims, 13 Drawing Sheets

ELECTRIC WASHING MACHINE

BACKGROUND OF THE INVENTION

1. Field of the Invention

The present invention relates to an electric washing machine such as a drum-type washing machine.

2. Description of Related Art

There have been conventionally known electric washing machines which are configured to supply ozone into a laundry containing tub which contains laundry and clean the laundry in the laundry containing tub with the use of the supplied ozone (see, for example, JP-A1-2005-334636).

A drum-type washing machine disclosed in JP-A1-2005-334636 includes a tub (laundry containing tub), an odor sensor which detects the odor of air in the tub, a fragrance supplying device which generates fragrance, and an ozone generating device which generates ozone. In the drum-type washing machine, a laundry deodorizing process is performed independently of a washing process by supplying ozone to the laundry when the odor sensor detects the air odor in the tub, i.e., unpleasant odor of the laundry. Unless the odor sensor detects the air odor in the tub, it is judged that the laundry has no unpleasant odor, and a fragrance imparting process is performed on the laundry by supplying the fragrance to the laundry.

In the drum-type washing machine disclosed in JP-A1-2005-334636, it is necessary to sufficiently prevent the ozone, the fragrance and other gases from leaking to the outside. Particularly, if an opening of the tub through which the laundry is loaded and unloaded is closed by a door with the laundry protruding out of the tub through the opening, the protruding laundry is caught between the peripheral edge of the opening and the door to form a gap between the peripheral edge of the opening and the door. Therefore, the gases are liable to leak to the outside.

SUMMARY OF THE INVENTION

In view of the foregoing, it is an object of the present invention to provide an electric washing machine which is configured so that a gas to be used for performing a specific process (decontamination process) on laundry is prevented from leaking to the outside.

An electric washing machine according to the present invention comprises: a housing; a cover member defining a front wall of the housing and having an access opening through which laundry is loaded and unloaded into and out of the housing; a laundry containing tub disposed in the housing and having a tub opening provided in association with the access opening so that the laundry is loaded therein through the access opening and the tub opening to be contained therein; a door which opens and closes the access opening and the tub opening; and a packing which covers a peripheral edge of the tub opening and is brought into intimate contact with the door for sealing a gap defined between the door and the peripheral edge of the tub opening when the door is closed, the packing being opposed to the access opening with a space defined between a lower edge portion of the access opening and the packing.

The cover member may have a plurality of ribs provided adjacent the lower edge portion of the access opening thereof as extending downward and arranged at intervals smaller than the size of a coin along the space defined between the lower edge portion of the access opening and the packing.

The door may have a guide wall extending toward the space.

The electric washing machine may further comprise an inclined wall disposed below the space and inclined forwardly downward to be connected to the cover member.

The packing may have a shutter portion which covers the space when the door is opened, and uncovers the space when the door is closed.

The cover member may have a first engagement portion provided adjacent the lower edge portion of the access opening, and the door may have a second engagement portion to be engaged with the first engagement portion when the door is closed.

According to the present invention, the cover member defining the front wall of the housing of the electric washing machine has the access opening through which the laundry is loaded and unloaded into and out of the housing. The laundry containing tub provided in the housing has the tub opening in association with the access opening of the cover member. The laundry can be loaded into the laundry containing tub from the front side of the electric washing machine through the access opening and the tub opening. Further, the access opening and the tub opening are opened and closed by the door.

The electric washing machine includes the packing which covers the peripheral edge of the tub opening of the laundry containing tub and is brought into intimate contact with the door to seal the gap defined between the door and the peripheral edge of the tub opening when the door is closed. This ensures the gas-tightness of the laundry containing tub around the tub opening when the door is closed.

The lower edge portion of the access opening of the cover member is a portion through which the laundry is most liable to protrude out of the laundry containing tub. If the door is closed with the laundry protruding out of the laundry containing tub, the protruding laundry is caught between the door and the packing. Therefore, a part of the packing is not brought into intimate contact with the door around the lower edge portion of the access opening. If a gas to be used for performing a specific process (decontamination process) on the laundry is supplied into the laundry containing tub, the gas flows toward the access opening of the cover member through a gap between the door and the packing at which the laundry is caught. Since the packing is opposed to the access opening with the space defined between the packing and the lower edge portion of the access opening, the gas flowing toward the access opening of the cover member flows into the space to be thereby retained in the housing. That is, the gas is prevented from reaching the access opening to leak through the access opening to the outside.

Where a greater proportion of the laundry protrudes through the access opening of the cover member, for example, it is impossible to close the door. In such a case, a user eliminates the protrusion of the laundry to prevent the laundry from being caught between the door and the packing. Further, a sensor for detecting an opening/closing state of the door, for example, may be provided. In this case, when a door unclosed state is detected by the sensor, the user is notified of the door unclosed state, and the operation of the laundry washing machine is interrupted until the protrusion of the laundry is eliminated.

Where a smaller proportion of the laundry protrudes such as to permit the door to be closed or such as not to be detected by the sensor, however, it is difficult for the user to recognize the protrusion of the laundry. In the present invention, even if the laundry is inevitably caught between the door and the packing, it is possible to prevent the leak of the gas which may otherwise occur due to the caught laundry.

Since the cover member has the plurality of ribs provided adjacent the lower edge portion of the access opening thereof as extending downward and arranged at intervals smaller than the size of a coin along the space defined between the lower edge portion of the access opening and the packing, small articles such as a coin are prevented from dropping into the inner side of the housing through the space.

Further, the door has the guide wall extending toward the space defined between the packing and the lower edge portion of the access opening of the cover member. With this arrangement, even if the gas flows toward the access opening from the laundry containing tub when the laundry protruding through the lower edge portion of the access opening is caught between the closed door and the packing as described above, the gas is guided by the guide wall to smoothly flow toward the space. This reliably prevents the gas from reaching the access opening to leak through the access opening to the outside.

The inclined wall is disposed below the space between the packing and the lower edge portion of the access opening of the cover member as being inclined forwardly downward to be connected to the cover member. If foreign matter intrudes into the space, the foreign matter is liable to drop into the housing through the space. If the foreign matter is water, an electrical component such as a board located below the space would be splashed with the water to suffer from malfunction without the provision of the inclined wall. With the provision of the inclined wall below the space, however, the water intruding into the space is guided forwardly downward along the inclined wall. This prevents the component located below the space in the housing from being splashed with the water. Of course, foreign matter other than the water is also prevented from hitting against the component located below the space to damage the component. Since a trapping recess is defined by the cover member and the inclined wall which is inclined forwardly downward to be connected to the cover member, the foreign matter intruding into the space is trapped by the trapping recess. Therefore, the foreign matter trapped by the trapping recess can be removed by detaching the cover member from the housing.

The packing has the shutter portion which covers the space between the packing and the lower edge portion of the access opening of the cover member when the door is opened, and uncovers the space when the door is closed. With this arrangement, the space is covered with the shutter portion when the door is opened, so that the appearance of the periphery of the access opening is improved. Further, the space is uncovered with the shutter portion when the door is closed, so that the gas is caused to flow into the space. Therefore, the gas is prevented from leaking to the outside.

The cover member has the first engagement portion provided adjacent the lower edge portion of the access opening, and the door has a second engagement portion to be engaged with the first engagement portion when the door is closed. When the laundry protrudes out of the laundry containing tub to the lower edge portion of the access opening, the protruding laundry is located between the first engagement portion and the second engagement portion. Therefore, the second engagement portion cannot be completely engaged with the first engagement portion, making it impossible to close the door. This causes the user to recognize the protrusion of the laundry, and prompts the user to eliminate the protrusion. Thus, the laundry is prevented from being caught between the door and the cover member. Therefore, the gas is prevented from leaking to the outside.

Embodiments of the present invention will hereinafter be described in detail with reference to the attached drawings.

DETAILED DESCRIPTION OF PREFERRED EMBODIMENTS

Overall Construction of Electric Washing Machine

Figure 1:
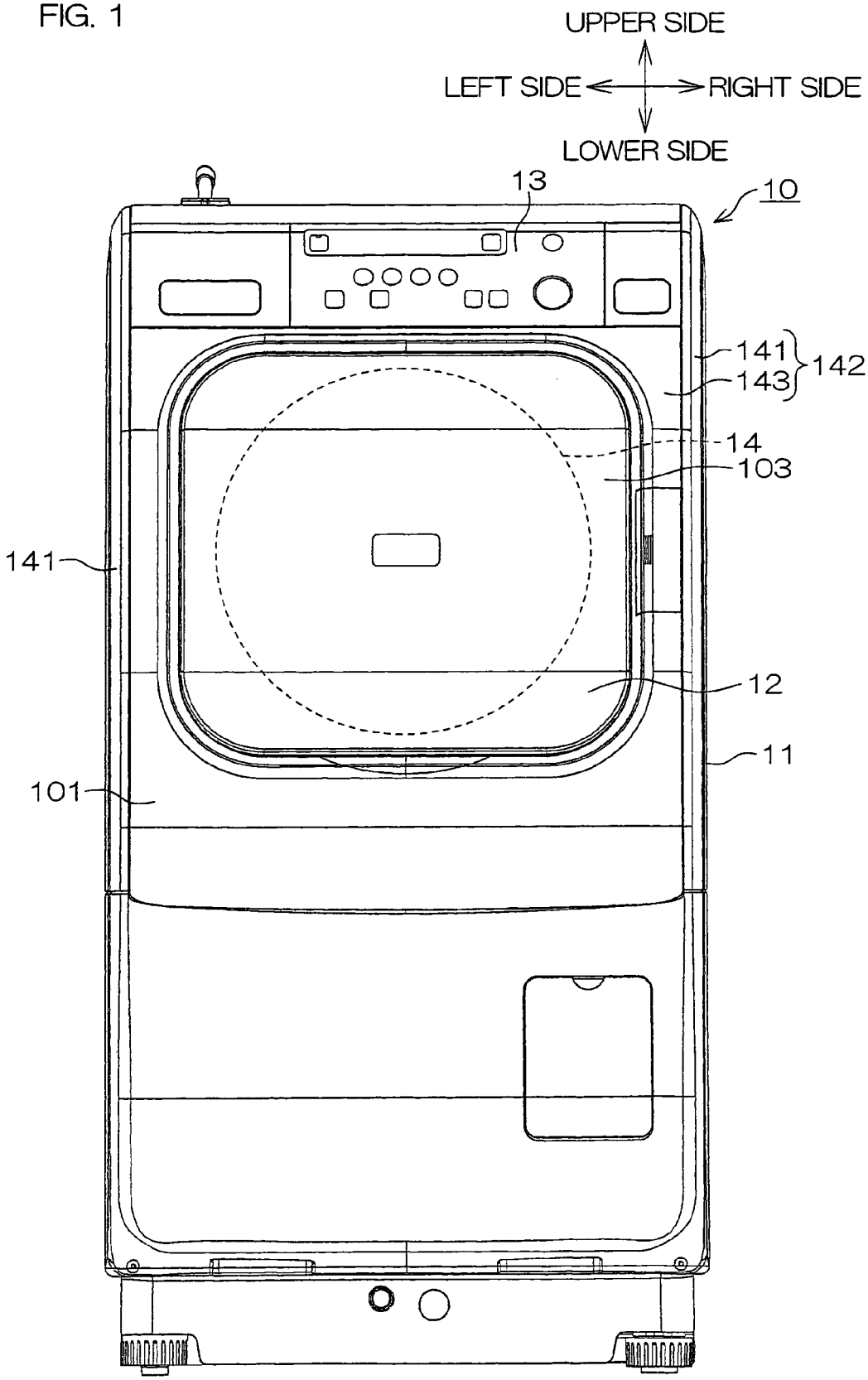
FIG. 1 is a front view of an electric washing machine 10 according to one embodiment of the present invention.

FIG. 1 is a front view of an electric washing machine 10 according to one embodiment of the present invention. Reference will be made to directional arrows shown in FIG. 1 for directional notation (this holds true for the other figures). Here, the front side is equivalent to the forward side, and the rear side is equivalent to the rearward side.

The electric washing machine 10 includes a housing 11 which defines an outer shell of the electric washing machine 10 and has a vertically elongated and generally rectangular shape as seen from the front side. A washing tub (to be described later) is disposed in an upper portion of the housing 11, and a water storage tank (to be described later) is disposed in a lower portion of the housing 11.

The housing 11 has a housing opening 14 provided as an access opening in an upper front face portion thereof. A door 12 is provided on the housing opening 14 for opening and closing the housing opening 14 and an outer tub opening 118 (to be described later). Laundry is loaded and unloaded into and out of the housing 11 through the housing opening 14. The door 12 has a major face formed of a transparent reinforced glass, for example, so that the laundry in the washing tub in the housing 11 can be observed through the door 12.

An operation/display portion 13 is disposed above the door 12 on the upper front face portion of the housing 11. A plurality of operation keys and a display device are arranged on the operation/display portion 13. Various information on processes to be performed by the electric washing machine 10 is displayed on the display device.

Figure 2:
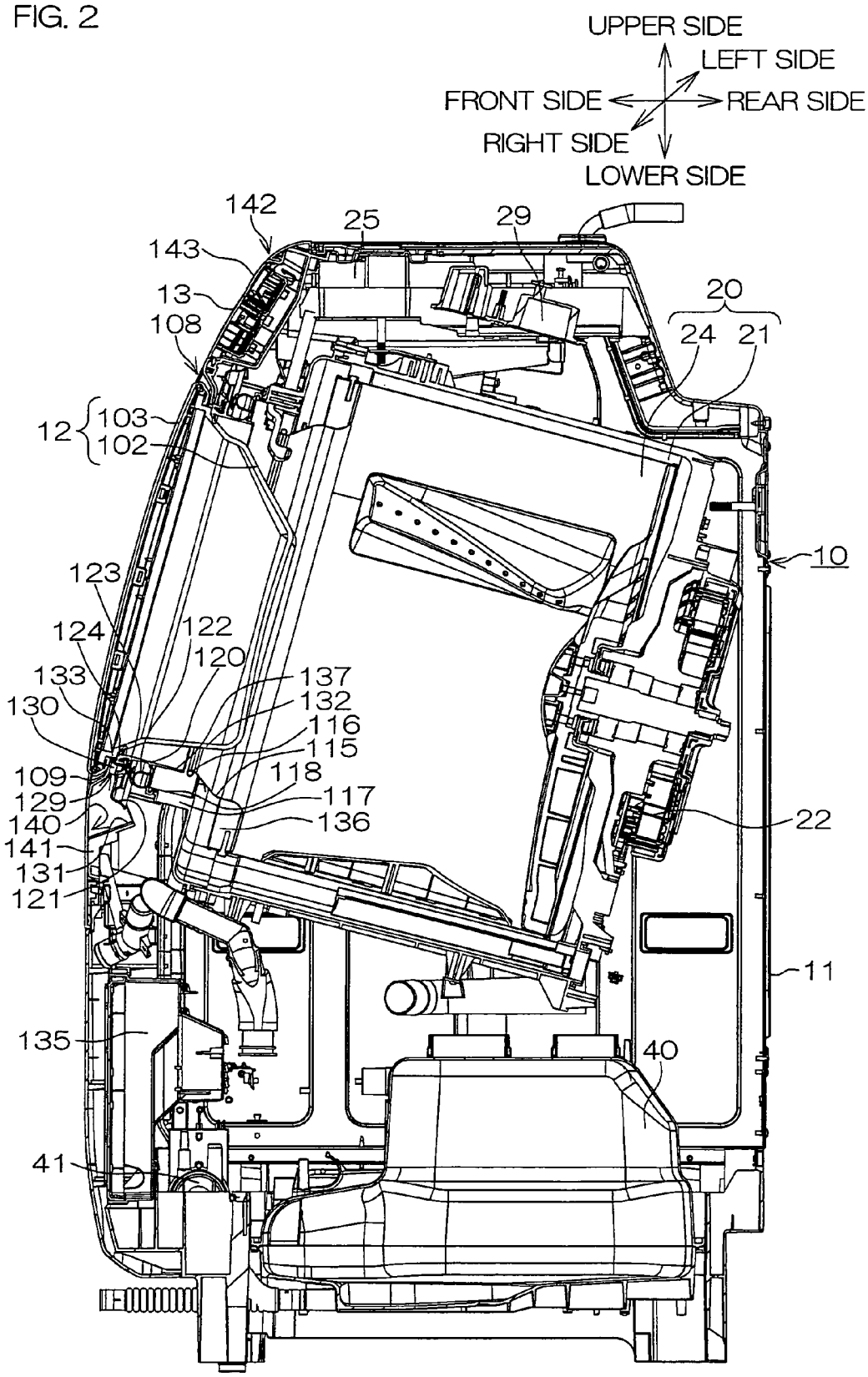
FIG. 2 is a sectional view of the electric washing machine 10 as seen from the right side with a door 12 being closed.
Figure 3:
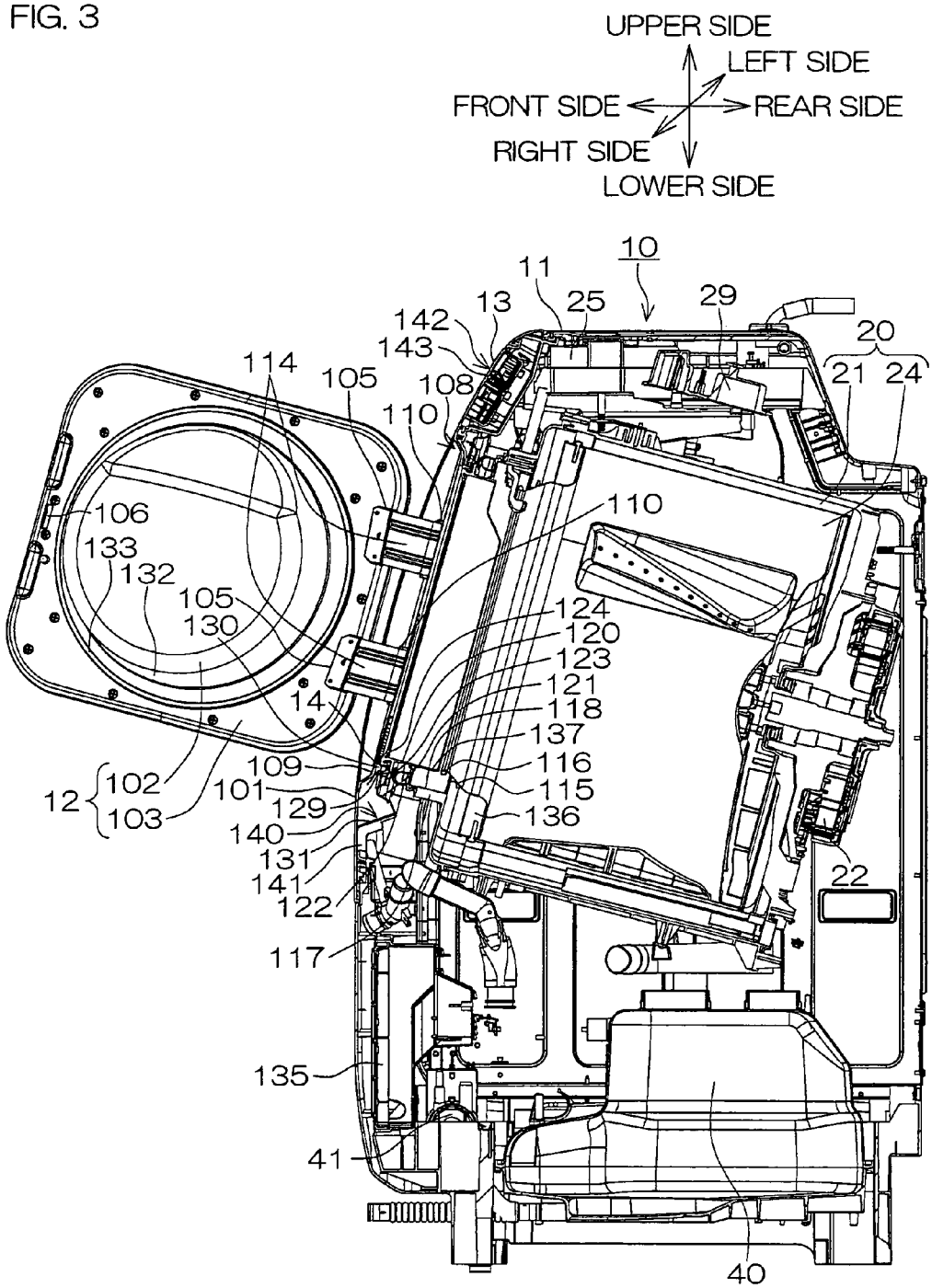
FIG. 3 is a sectional view of the electric washing machine 10 as seen from the right side with the door 12 being opened.

FIG. 2 is a sectional view of the electric washing machine 10 as seen from the right side with the door 12 being closed. FIG. 3 is a sectional view of the electric washing machine 10 as seen from the right side with the door 12 being opened.

Referring to FIGS. 2 and 3, a washing tub 20 capable of containing the laundry is provided in the housing 11 of the electric washing machine 10. The washing tub 20 includes an outer tub 21 and a cylindrical drum 24 provided in the outer tub 21. A DD motor 22 is attached to a rear face of the outer tub 21. The drum 24 is rotated in the outer tub 21 by the DD motor 22. The electric washing machine 10 has a so-called tilted drum structure in which the drum 24 has a rotation shaft tilted forwardly upward with respect to a horizontal axis. The outer tub 21 is attached to a bottom of the housing 11 by a plurality of dampers (not shown).

A water supply unit 25 is provided on an upper left side of the outer tub 21. The water supply unit 25 is a unit through which water is supplied into the outer tub 21 for a washing process and a rinsing process. A detergent container 47 (see FIG. 4) is provided in the unit 25. The supplied water flows into the detergent container 47, and supplied together with a detergent or without the detergent.

The electric washing machine 10 can use bath water for the washing process and the rinsing process. For this purpose, a bath water pump 26 (see FIG. 4) is provided adjacent the water supply unit 25 on a right side of the water supply unit 25 for pumping up the bath water.

In addition to the washing process and the rinsing process, a drying process is performed in the washing tub 20. For this purpose, a drying air duct 28 (see FIG. 4) is connected to a right rear portion of the outer tub 21. While humid air flowing out of the outer tub 21, for example, from a rear lower portion of the outer tub 21 is guided upward through the drying air duct 28, the air is dehumidified. A blower unit 29 is connected to an upper portion of the drying air duct 28 through a connection hose 60 (see FIG. 4). The air guided through the drying air duct 28 and dehumidified in the drying air duct 28 is fed into the outer tub 21 by the blower unit 29. A heater (not shown) for heating the air to be fed into the outer tub 21 is provided in the blower unit 29.

The electric washing machine 10 further includes an ozone generating unit 30 (see FIG. 4) provided adjacent the blower unit 29. As will be described later, the ozone generating unit 30 functions as water decontamination means, and also serves for sterilization and deodorization of laundry being dried and for sterilization and deodorization of the laundry contained in the washing tub 20 by generating ozone in the drying process and an air-washing process. The air-washing process is herein defined as a process which is performed independently of the washing process and the drying process to kill bacteria adhering to the laundry and deodorize the laundry by applying ozone-containing air to the laundry contained in the drum 24. The applicant of the present invention refers to the decontamination (sterilization and deodorization) of the laundry with ozone as "air-washing" because the laundry is sterilized and deodorized with ozone-containing air as if the laundry were washed with the air in the air-washing process.

The electric washing machine 10 includes a water storage tank 40 provided below the washing tub 20. The water storage tank 40 serves to store water drained from the outer tub 21 and bath water pumped up by the bath water pump 26 (see FIG. 4). A circulation pump 41 for pumping up water from the water storage tank 40 is provided adjacent the water storage tank 40.

The electric washing machine 10 includes a multiplicity of hoses for transferring water and ozone-containing air between the outer tub 21, the water supply unit 25, the drying air duct 28 (see FIG. 4), the water storage tank 40 and the like.

Figure 4:
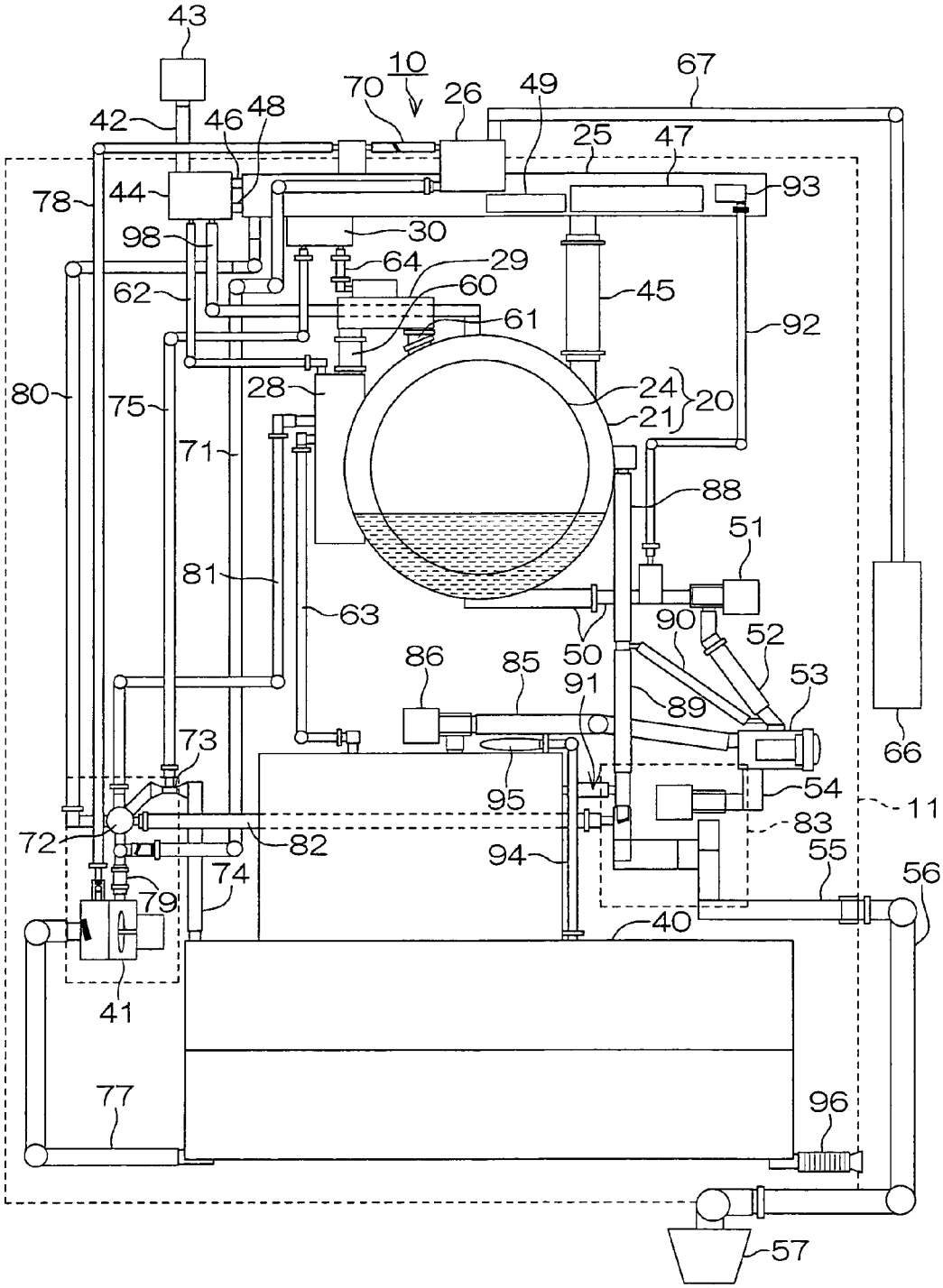
FIG. 4 is a decontamination circulation pipeline diagram illustrating a circulation water passage through which water is circulated in the electric washing machine 10 described with reference to FIGS. 1 to 3, and an ozone supply passage through which ozone-containing air is supplied.

FIG. 4 is a decontamination circulation pipeline diagram illustrating a circulation water passage through which water is circulated in the electric washing machine 10 described with reference to FIGS. 1 to 3, and an ozone supply passage through which ozone-containing air is supplied.

Referring to FIG. 4, tap water supplied from a water faucet 43 is supplied into the washing tub 20 through the water supply unit 25 and a connection hose 45 by controlling the opening and closing of a water supply valve 44. At this time, the water supply valve 44 is switched to cause the tap water to flow into the detergent container 47 provided in the water supply unit 25 through a first flow passage 46 or to flow into a softener container 49 provided in the water supply unit 25 through a second flow passage 48.

The water contained in the washing tub 20 (the outer tub 21) is drained by controlling the opening and closing of a drain valve 51 provided in a drain pipe 50. A filter unit 53 is connected to the drain valve 51 through an intermediate hose 52. The filter unit 53 traps lint and other foreign matter contained in the water drained from the outer tub 21. The water entering the filter unit 53 passes through a drain pipe 54 and a valve 83 to be drained out of the housing 11 through a drain hose 55. Outside the housing 11, the water is drained, for example, to a drain trap 57 through an external drain hose 56.

When the electric washing machine 10 performs the washing process or the rinsing process by using the tap water without exercising a water saving function, the water is supplied in the aforesaid manner.

In the drying process, a blower (not shown) of the blower unit 29 is actuated to cause the air to flow out of the washing tub 20 into the drying air duct 28 and then through the connection hose 60. Then, the air is heated in the blower unit 29, and fed back into the washing tub 20 through a connection hose 61. Hot and humid air flowing out of the washing tub 20 is dehumidified in the drying air duct 28 by heat exchange. For the dehumidification, the opening and closing of the water supply valve 44 is controlled to cause the tap water supplied from the water faucet 43 to flow into the drying air duct 28 through a water supply hose 62.

When the ozone generating unit 30 is actuated with the blower unit 29 being active, ozone generated by the ozone generating unit 30 is introduced into the blower unit 29 through an air hose 64 by a negative pressure generated by the blower unit 29. The introduced ozone is supplied into the washing tub 20 through the connection hose 61 for the sterilization and deodorization of the laundry contained in the drum 24.

When the electric washing machine 10 performs the drying process without exercising the water saving function, the water and the air are supplied in the aforesaid manner.

As described above, the electric washing machine 10 according to this embodiment can perform the washing process and the rinsing process by using the bath water. For this purpose, the bath water pump 26 is provided. A bath water hose 67 through which the bath water is pumped up from a bath tub 66 is connectable to the bath water pump 26. The bath water pump 26 is a self-priming pump, and a priming water passage 70 for supplying priming water is connected to the bath water pump 26. When the tap water supplied from the water faucet 43 is supplied into the water supply unit 25 by controlling the opening and closing of the water supply valve 44, a part of the tap water is supplied into the bath water pump 26 through the priming water passage 70. The supplied priming water causes the bath water pump 26 to pump up the bath water. The bath water pumped up through the bath water hose 67 flows through a water supply hose 71 connected to an outlet of the bath water pump 26 and further through a circulation valve 72, an ejector 73 and a connection hose 74, and is stored in the water storage tank 40.

If the ozone generating unit 30 is energized when the bath water passes through the ejector 73, the ozone generated by the ozone generating unit 30 is supplied to the ejector 73 through an air hose 75. The ozone is introduced into the ejector 73 from the air hose 75 by a negative pressure generated by the flow of the bath water, and mixed with the bath water. Thus, the bath water to be stored in the water storage tank 40 is mixed with the ozone to be subjected to a primary decontamination process during the supply thereof to the water storage tank 40. The primary decontamination process is performed when the bath water flows into the water storage tank 40.

The water storage tank 40 is connected to one end of a connection hose 77 through which the bath water stored in the water storage tank 40 is pumped up. The other end of the connection hose 77 is connected to a suction port of the circulation pump 41. The circulation pump 41 is also a self-priming pump, and priming water is supplied to the circulation pump 41 through a water supply hose 78. When the tap water supplied from the water faucet 43 is supplied to the water supply unit 25 by controlling the opening and closing of the supply valve 44, a part of the tap water is supplied to the bath water pump 26 through the priming water passage 70 as described above. At the same time, the tap water is supplied to the circulation pump 41 through the water supply hose 78.

The circulation valve 72 is connected to an outlet of the circulation pump 41. The circulation valve 72 is a five-way valve. The connection hose 74 is connected to a first outlet of the circulation valve 72 through the ejector 73, so that the water pumped up from the water storage tank 40 through the connection hose 77 can be circulated. By pumping up the water from the water storage tank 40 and circulating the water through the ejector 73, the water is mixed with the ozone generated by the ozone generating unit 30 when passing through the ejector 73. Thus, the bath water stored in the water storage tank 40 is subjected to a secondary decontamination process by using the ozone. The second decontamination process is performed by circulating the bath water stored in the water storage tank 40.

A water supply hose 80 is connected to a second outlet of the circulation valve 72. Thus, the water stored in the water storage tank 40 is supplied into the water supply unit 25 through the water supply hose 80, and further supplied into the washing tub 20 from the water supply unit 25 through the connection hose 45.

A connection hose 81 is connected to a third outlet of the circulation valve 72 at one end thereof, and the other end of the connection hose 81 opens in a chamber (not shown) in the drying air duct 28. Thus, the water discharged from the circulation pump 41 is cause to fall into the drying air duct 28 from the chamber to be used for the heat exchange in the water storage tank 40 [in the drying air duct 28]. A part of the water not used for the heat exchange flows back into the water storage tank 40 from the chamber through a connection hose 63.

A connection hose 82 is connected to a fourth outlet of the circulation valve 72 at one end thereof, and the other end of the connection hose 82 is connected to the drain pipe 54 through the valve 83. Thus, the water in the water storage tank 40 is drained to the outside through the drain hose 55 by switching the circulation valve 72 and controlling the opening and closing of the valve 83.

The electric washing machine 10 is adapted not only to store the bath water in the water storage tank 40 and decontaminate the bath water but also to store the water drained from the washing tub 20 after having been used for the washing process and the rinsing process. For this purpose, the filter unit 53 has an outlet connected to one end of an intermediate hose 85 in addition to an outlet connected to the drain pipe 54. The other end of the intermediate hose 85 communicates with the water storage tank 40 through a valve 86. Therefore, the water drained from the outer tub 21 is allowed to flow through the drain pipe 50, the drain valve 51, the intermediate hose 52, the filter unit 53, the intermediate hose 85 and the valve 86 to be stored in the water storage tank 40 by controlling the switching of the valve 83 and the valve 86.

The used water stored in the water storage tank 40 may also be circulated through a circulation passage including the connection hose 77, the circulation pump 41, the circulation valve 72, the ejector 73 and the connection hose 74 so as to be decontaminated with the use of the ozone.

An overflow hose 88 is connected to the outer tub 21 at one end thereof, and the other end of the overflow hose 88 is connected to one end of an overflow hose 89. The other end of the overflow hose 89 is connected to the valve 83. When the water contained in the outer tub 21 reaches a predetermined water level to overflow, the overflowing water is drained through the overflow hoses 88 and 89. At this time, the internal pressure of the outer tub 21 should be equal to the atmospheric pressure. Therefore, a connection portion between the overflow hoses 88 and 89 is connected to an inlet of the filter unit 53 through an air hose 90, so that the internal pressure of the outer tub 21 is equal to the atmospheric pressure.

An overflow hose 91 is provided for the water storage tank 40. The overflow hose 91 is connected to the drain hose 55 through the valve 83.

For detection of the water level in the washing tub 20, an air trap hose 92 is connected to the drain pipe 50 at its lower end, and a water level sensor 93 is provided at an upper end of the air trap hose 92. The water level in the washing tub 20 can be checked by the water level sensor 93.

An air trap hose 94 and a water level sensor 95 are provided for the water storage tank 40, so that the water level of the water stored in the water storage tank 40 can be detected.

The water storage tank 40 is provided with a manually openable drain hose 96, so that a maintenance operation can be performed on the water storage tank 40 after all the water is drained from the water storage tank 40.

The electric washing machine 10 further includes a water supply hose 98 which connects the water supply valve 44 to the outer tub 21. The tap water supplied from the water faucet 43 can be directly supplied into the washing tub 20 through the water supply hose 98 by controlling the switching and the opening and closing of the water supply valve 44. The tap water supplied into the washing tub 20 is applied in a shower form to the laundry contained in the drum 24. That is, a so-called shower rinsing process can be performed by supplying the tap water into the washing tub 20 through the water supply hose 98.

Characteristic components of the electric washing machine 10 will hereinafter be described.

Door and Cover Member

Figure 5:
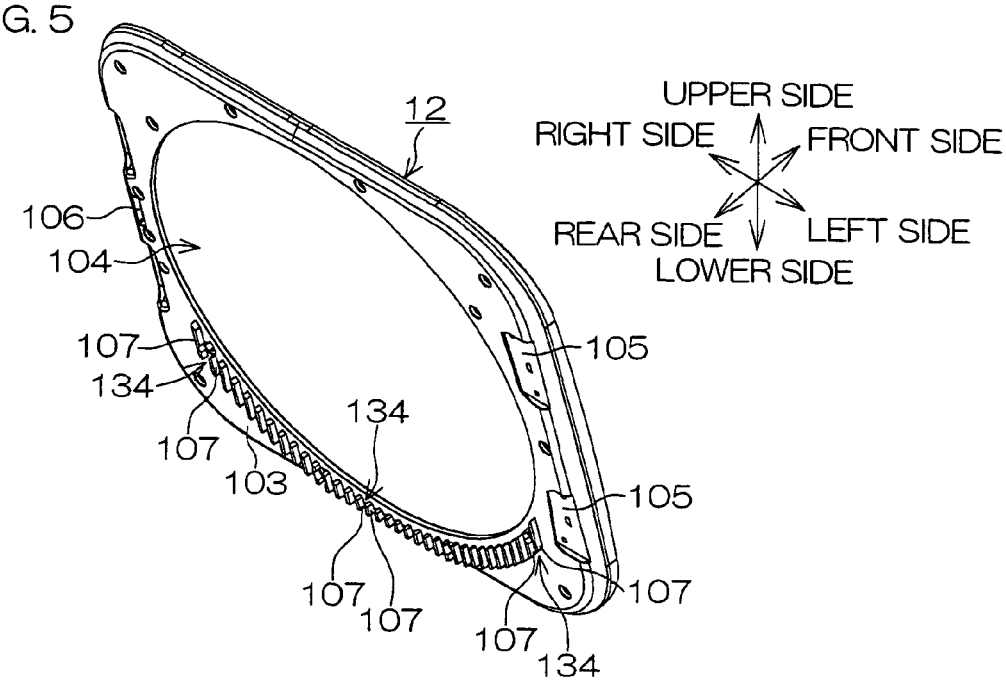
FIG. 5 is a rear perspective view of a frame 103 of the door 12.
Figure 6:
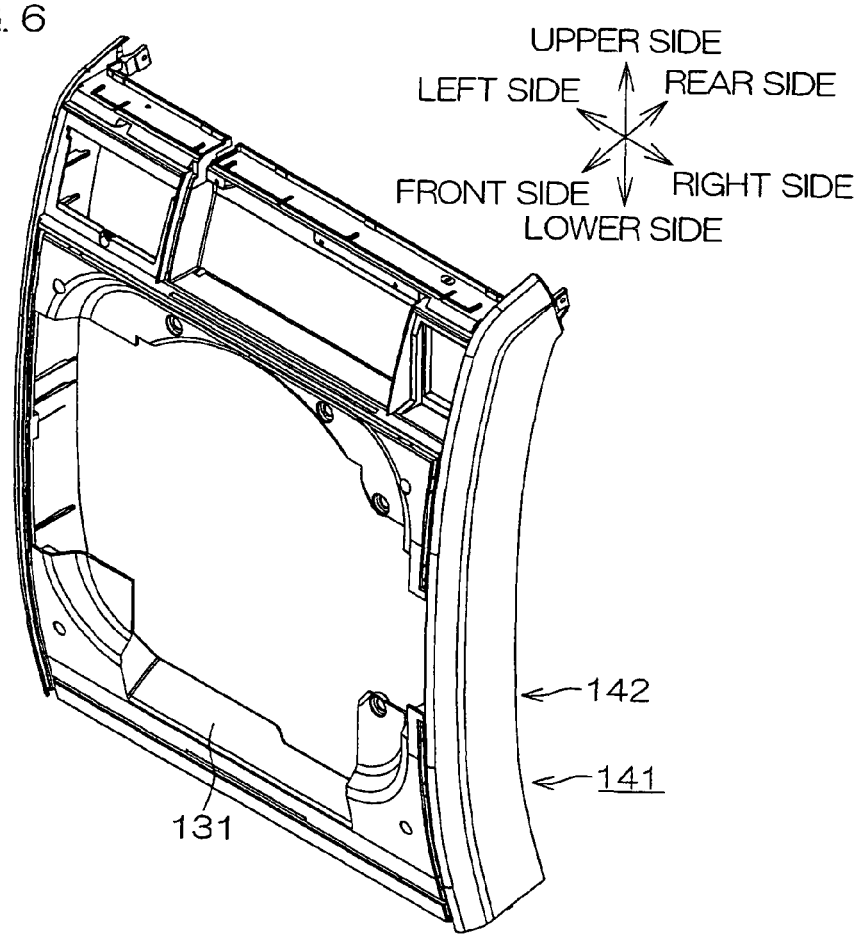
FIG. 6 is a front perspective view of a front frame 141.
Figure 7:
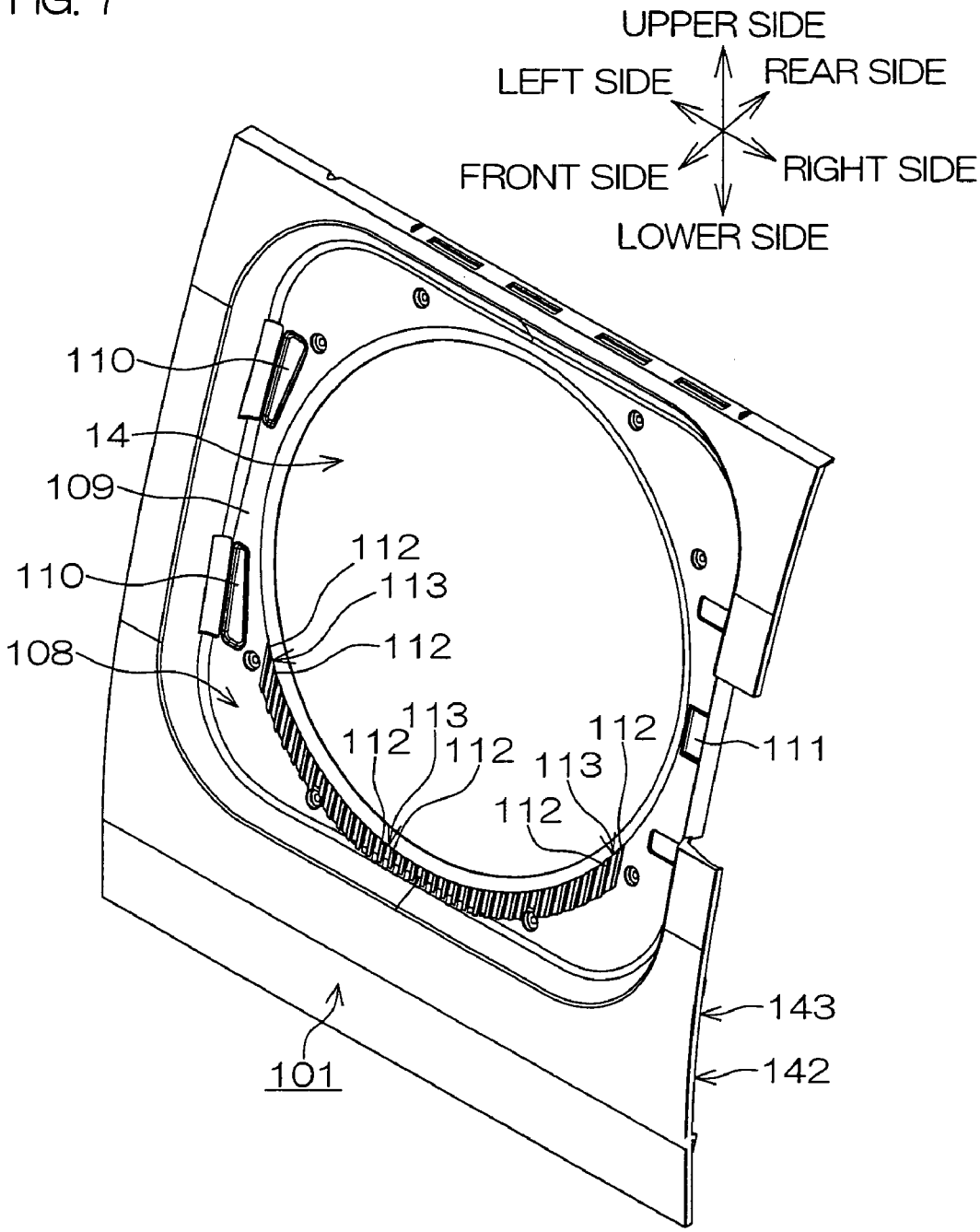
FIG. 7 is a front perspective view of a cover 101.

FIG. 5 is a rear perspective view of a frame 103 of the door 12. FIG. 6 is a front perspective view of a front frame 141. FIG. 7 is a front perspective view of a cover 101.

Referring to FIGS. 5 to 7, a front portion of the housing 11 will be described in detail.

As shown in FIG. 5, the door 12 includes a glass portion 102 composed of the aforesaid reinforced glass (see FIG. 2) and a frame 103 supporting the glass portion 102. The glass portion 102 has a generally truncated cone shape which is gradually tapered rearward with the door 12 being closed (see FIG. 2). The glass portion 102 will be described in detail later. The frame 103 has a rectangular shape having round corners as seen from the front side (see FIG. 1). The frame 103 has a recess 104 provided in a center portion of a rear face thereof as being indented forward and having a round shape as seen from the rear side. The glass portion 102 (see FIG. 2) is attached to the frame 103 with its front edge fitted in the recess 104. The frame 103 has two door hinge attachment portions 105 provided in vertically spaced relation in a left edge portion of the rear surface thereof, and an engagement portion 106 provided at a generally vertically middle position in a right edge portion of the rear surface thereof. The door hinge attachment portions 105 and the engagement portion 106 will be described in detail later. A plurality of door projections 107 are provided on a rear surface portion of the frame 103 adjacent to a lower peripheral edge portion of the recess 104 as being arranged equidistantly along the lower peripheral edge portion of the recess 104. The door projections 107 are located slightly below the lower peripheral edge portion of the recess 104 as vertically extending and projecting rearward. With the provision of these door projections 107, recesses (door recesses 134) are defined between adjacent door projections 107. The door projections 107 and the door recesses 134 serve as a second engagement portion.

As shown in FIG. 1, the front wall of the housing 11 is divided at a generally vertically middle position into two front wall portions, which are independently detachable from the housing 11. An upper half front wall portion of the housing 11 is herein referred to as a cover member 142. The cover member 142 includes the front frame 141 serving as a skeletal structure (see FIG. 6), and a decorative face member 143 covering the front frame 141 from the front side. The front frame 141 has an elongated rectangular frame shape as seen from the front side, and integrally includes an inclined wall 131 provided at a generally laterally intermediate position on the lowermost frame portion thereof as extending obliquely upwardly rearward (see FIG. 6). The inclined wall 131 will be described in detail later.

The decorative face member 143 is vertically divided into an upper portion in which the operation/display portion 13 is located and a lower portion below the operation/display portion 13. The upper and lower portions of the decorative face member 143 are detachable from the front frame 141 (see FIG. 6). The lower portion of the decorative face member 143 below the operation/display portion 13 is herein referred to as a cover 101. With the cover 101 attached to the front frame 141, a rear surface of the cover 101 is exposed rearward from the front frame 141.

Alternatively, the cover member 142 may include the front frame 141 and the decorative face member 143 as a unitary member.

As shown in FIG. 7, the cover 101 is a vertically elongated rectangular thin plate of a resin as seen from the front side, and is slightly inclined upwardly rearward. The cover 101 includes a door placement portion 108 provided in an upwardly offset position thereof. The door placement portion 108 has a generally rectangular shape which is conformal to the contour of the frame 103 (see FIG. 5) as seen from the front side, and is recessed rearward. The aforementioned housing opening 14 (see FIG. 1) is provided in a generally center portion of the innermost portion 109 of the door attachment portion 108 as seen from the front side. More specifically, the housing opening 14 is of a round shape as seen from the front side, and extends anteroposteriorly through the cover 101. The cover 101 has two cover hinge through-holes 110 provided in vertically spaced relation along a left edge of the innermost portion 109 thereof as extending therethrough, and an engagement portion 111 provided at a generally vertically middle position in a right edge portion of the innermost portion 109 thereof on a front surface of the innermost portion 109 thereof. The cover hinge through-holes 110 and the engagement portion 111 will be described in detail later. A plurality of cover projections 112 are provided on a front surface portion of the innermost portion 109 adjacent to a lower peripheral edge portion of the housing opening 14 as being arranged equidistantly along the lower peripheral edge portion of the housing opening 14. The cover projections 112 are located slightly below the lower peripheral edge portion of the housing opening 14 as vertically extending and projecting forward. With the provision of these cover projections 112, recesses (cover recesses 113) are defined between adjacent cover projections 112. A rear face structure of the cover 101 will be described in detail later. The cover projections 112 and the cover recesses 113 serve as a first engagement portion.

Figure 8:
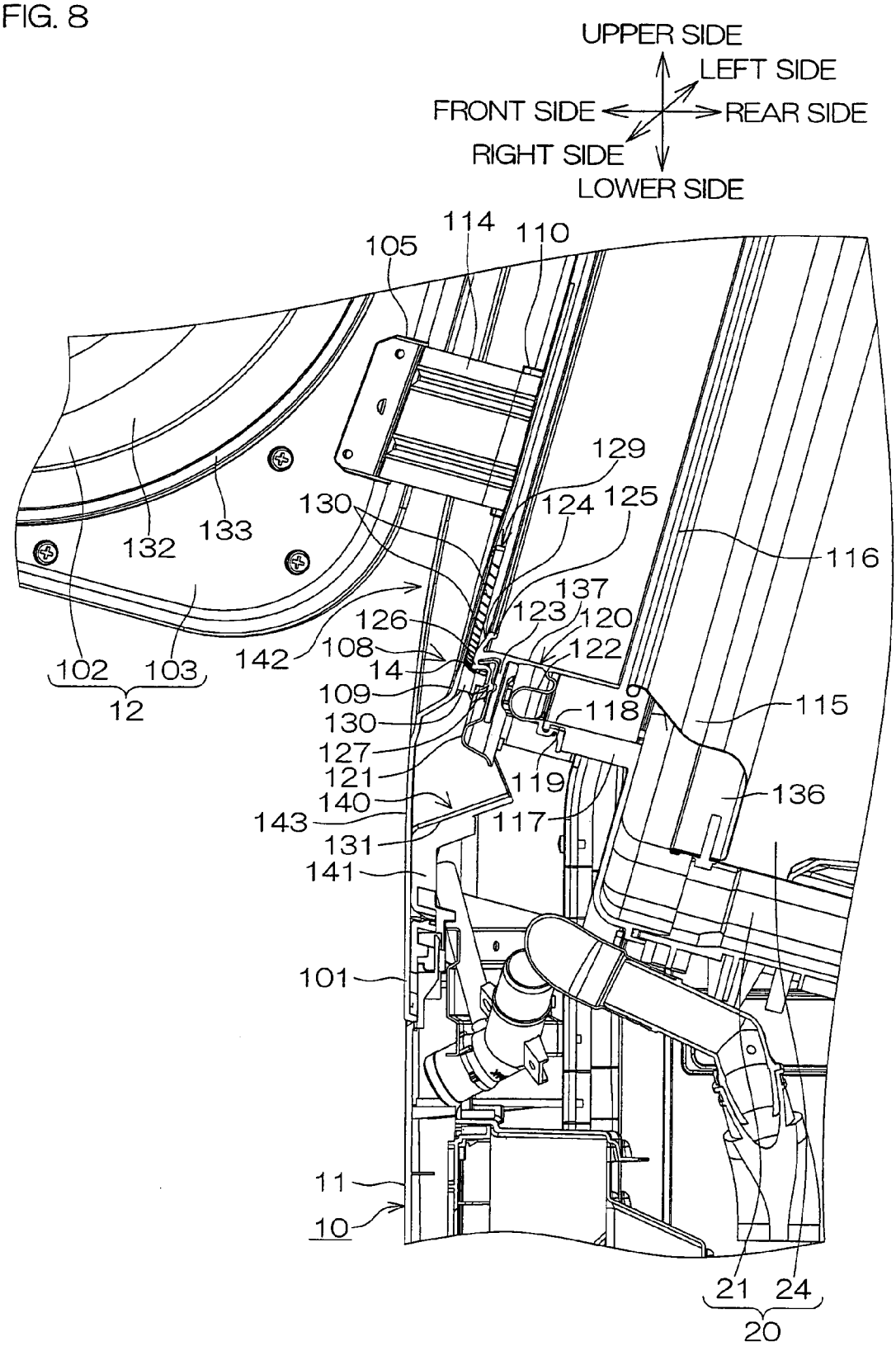
FIG. 8 is a sectional view of major portions provided in a front portion of a housing 11 as seen from the right side with the door 12 being opened.
Figure 9:
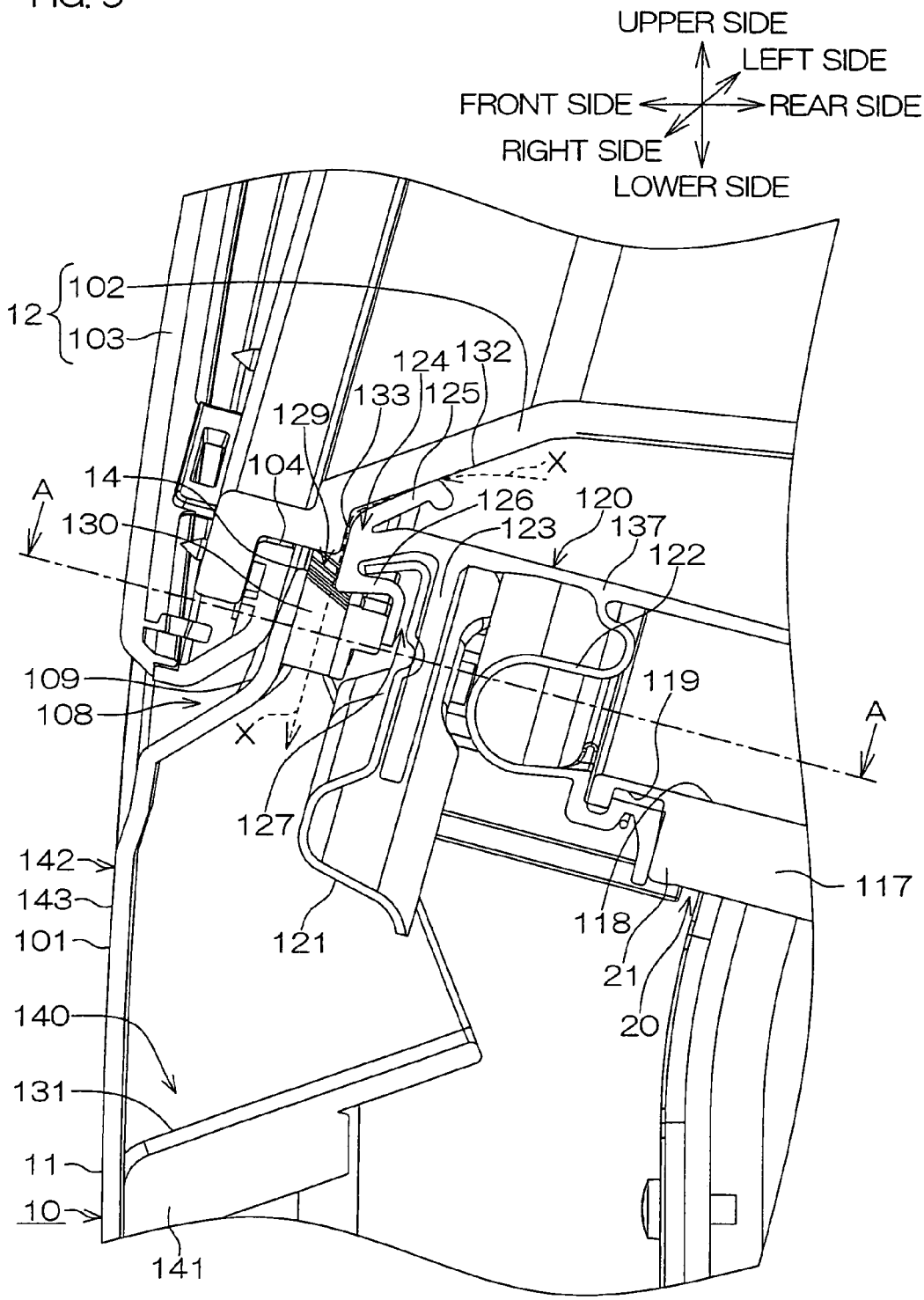
FIG. 9 is a diagram corresponding to FIG. 8 with the door 12 being closed.
Figure 10:
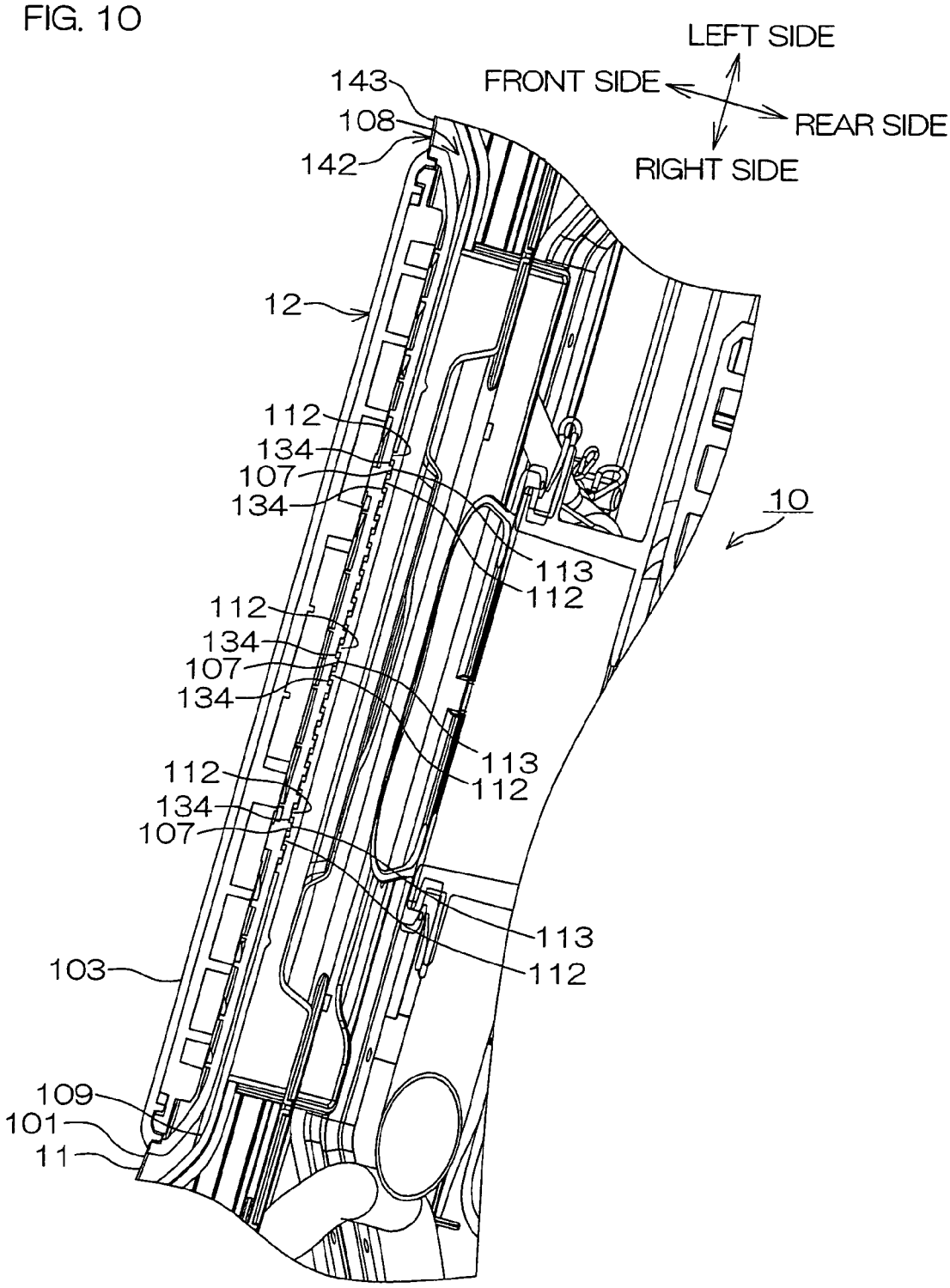
FIG. 10 is a sectional view seen in an arrow direction A-A in FIG. 9.

FIG. 8 is a sectional view of major portions provided in a front portion of the housing 11 as seen from the right side with the door 12 being opened. In FIG. 8, the door projections 107, the door recesses 134, the cover projections 112 and the cover recesses 113 are not shown for convenience of explanation. FIG. 9 is a diagram corresponding to FIG. 8 with the door 12 being closed. FIG. 10 is a sectional view seen in an arrow direction A-A in FIG. 9. In FIG. 10, the door projections 107, the door recesses 134, the cover projections 112 and the cover recesses 113 not shown in FIG. 8 and 9 are shown.

As shown in FIG. 8, one edge portion of a hinge 114 is attached to a lower one of the door hinge attachment portions 105 of the frame 103 of the door 12. The other edge portion of the hinge 114 extends through a lower one of the cover hinge through-holes 110 of the innermost portion 109 of the cover 101. Though not shown, the other edge portion of the hinge 114 is attached to a packing support portion 121 to be described later. The packing support portion 121 is a metal plate which extends between transversely opposite side walls of the housing 11 to impart the front portion of the housing 11 with sufficient rigidity. Thus, the lower door hinge attachment portion 105 is connected to the packing support portion 121 via the hinge 114. Similarly, the upper door hinge attachment portion 105 of the flame 103 (see FIG. 5) is connected to the packing support portion 121 via another hinge 114. Thus, the door 12 is supported pivotally about axes of the hinges 114 by the packing support portion 121, so that the door 12 can be opened and closed as described above.

Packing

Other components of the washing machine 20 will hereinafter be described and, particularly, a packing 120 will be described in detail.

The drum 24 includes a front edge portion (drum projection portion) 115 having a reduced diameter and projecting forward, and the drum projection portion 115 has a round opening (inner tub opening) 116 as seen from the front side. An annular balance box 136 is attached to the periphery of the drum projection portion 115. The balance box 136 is composed of, for example, a resin, and serves to prevent eccentric rotation of the drum 24.

Like the drum 24, the outer tub 21 includes a front edge portion (outer tub projection portion) 117 having a reduced diameter and projecting forward, and the outer tub projection portion 117 has a round outer tub opening 118 as seen from the front side. The outer tub opening 118 is located in association with the housing opening 14. More specifically, the outer tub opening 118 is opposed to the housing opening 14 from the rear side. The inner tub opening 116 is located on a radially inner side of the outer tub opening 118. In the electric washing machine 10, the laundry is loaded into the drum 24 through the housing opening 14, the outer tub opening 118 and the inner tub opening 116 from the front side.

An attachment groove 119 is provided in a front edge portion of an outer peripheral surface of the outer tub projection portion 117 as extending continuously circumferentially thereof and recessed toward the center of the round outer tub opening 118. A packing 120 is attached to the outer tub projection portion 117.

The packing 120 is composed of, for example, a rubber, and covers a peripheral edge of the outer tub opening 118. The packing 120 includes a tubular tube portion 137 having substantially the same diameter as the inner tub opening 116. A first projection 122, a second projection 123 and a third projection 124 are integrally provided in this order from the rear side to the front side on an outer peripheral surface of the tube portion 137.

The first projection 122 is continuous circumferentially along the entire outer peripheral surface of the tube portion 137, and meanders radially outward from the outer peripheral surface of the tube portion 137 and projects rearward. A distal edge of the first projection 122 is fitted in the attachment groove 119 of the outer tub projection portion 117.

The second projection 123 is continuous circumferentially along the entire outer peripheral surface of the tube portion 137, and extends straight radially outward from the outer peripheral surface of the tube portion 137.

The third projection 124 is continuous circumferentially along the entire front peripheral edge of the tube portion 137, and includes an inner projection portion 125 and an outer projection portion 126. The inner projection portion 125 is slightly inclined rearward and radially inward of the tube portion 137 from a front edge of the tube portion 137 and slightly bent rearward. The outer projection portion 126 slightly extends radially outward of the tube portion 137 from the front edge of the tube portion 137 to be bent rearward, and is bent again just short of the second projection 123 to extend radially outward along the second projection 123. The packing 120 has a generally L-shaped gap 127 defined between the outer projection portion 126, the outer peripheral surface of the tube portion 137 and the second projection 123 as seen circumferentially of the tube portion 137.

The packing support portion 121 is a metal plate disposed on a front side of the outer tub opening 118 as extending between the transversely opposite side walls of the housing 11, and has a round hole provided in a transversely intermediate portion thereof as having a greater diameter than the tube portion 137. The packing support portion 121 includes a peripheral edge portion bent forward around the round hole, and a forwardly bulged circumferential portion located radially outward of the round hole.

The peripheral edge portion of the packing support portion 121 is fitted in the L-shaped gap 127. As described above, the distal edge of the first projection 122 is fitted in the attachment groove 119 of the outer tub projection portion 117. Thus, the packing 120 is fixed to the outer tub 21. In this state, a rear peripheral edge of the packing 120 is anteroposteriorly opposed to and spaced a very small distance from the peripheral edge of the inner tub opening 116. A front peripheral edge of the packing 120 is anteroposteriorly opposed to the peripheral edge of the housing opening 14 of the cover 101 of the cover member 142 with a predetermined space 129 (e.g., at least about 3 mm) defined between the front peripheral edge of the packing 120 and the lower peripheral edge portion of the housing opening 14. Since the outer projection portion 126 of the third projection 124 of the packing 120 is located outward of the peripheral edge of the housing opening 14, the outer peripheral edge of the front portion of the packing 120 is hidden by the cover 101 as seen from the front side. This improves the appearance of the periphery of the housing opening 14.

A plurality of ribs 130 are provided on a rear surface of the cover 101 of the cover member 142 as being equidistantly arranged along a generally lower half of the peripheral edge of the housing opening 14. A distance between each two adjacent ribs 130 is set smaller than the size of a coin. The ribs 130 project to a lower side of the outer projection portion 126 of the third projection 124 below the space 129 to be located below the front portion of the packing 120. In other words, the ribs 130 extend downward along the space 129 defined between the lower edge portion of the housing opening 14 and the packing 120 opposed to each other. The provision of the ribs 130 prevents small articles such as a coin from dropping into the inner side of the housing 11 through the space 129.

The inclined wall 131 of the front frame 141 is disposed behind the cover 101 of the cover member 142. More specifically, the inclined wall 131 is disposed below the space 129, and is inclined forwardly downward to be connected to a rear surface portion of the cover 101 below the door placement portion 108. Therefore, the inclined wall 131 is seen below the space 129 when the space 129 is looked down from the upper side.

Where foreign matter intrudes into the space 129, for example, the foreign matter is liable to drop into the housing 11 through the space 129. Here, a board case 135 (see FIG. 3) which accommodates a board as an electrical component is disposed below the space 129 in the housing 11. If the foreign matter is water, the board case 135 would be splashed with water to suffer from malfunction without the provision of the inclined wall 131. With the provision of the inclined wall 131 below the space 129, however, the water intruding into the space 129 is guided forwardly downward along the inclined wall 131, so that the board case 135 is prevented from being splashed with the water. Of course, the inclined wall 131 also prevents damage to the board case 135 which may otherwise occur when foreign matter other than the water hits against the board case 135. Further, a trapping recess 140 is defined by the cover member 142 and the inclined wall 131 inclined forwardly downward to be connected to the cover 101 of the cover member 142, so that the foreign matter intruding into the space 129 is trapped in the trapping recess 140. Therefore, the foreign matter trapped in the trapping recess 140 can be removed by detaching the cover member 142 from the housing 11.

When the door 12 is closed, the glass portion 102 of the door 12 is fitted within the packing 120 as shown in FIG. 9. An outer periphery (door inclined portion) 132 of the glass portion 102 has a diameter progressively increasing toward the front side with the door 12 being closed. The glass portion 102 has a door guide portion 133 which is sharply bent to extend toward the space 129 with the door inclined portion 132 being located in opposed relation to the third projection 124 at the front portion of the packing 120. Therefore, with the door 12 being closed, the inner projection portion 125 of the third projection 124 of the packing 120 is entirely kept in press contact with the door inclined portion 132 of the glass portion 102 on the rear side of the door guide portion 133. Thus, the front peripheral edge of the packing 120 is brought into intimate contact with the glass portion 102 of the door 12, so that the inside of the packing 120 on the rear side of a press-contact portion between the door inclined portion 132 and the inner projection portion 125 is isolated from the housing opening 14. Since a gap defined between the door 12 and a front peripheral edge of the outer tub opening 118 is sealed with the packing 120, the inside of the outer tub 21 is also isolated from the housing opening 14, i.e., from the outside. By thus providing the packing 120, the gas-tightness of the inside of the outer tub 21 around the outer tub opening 118 is ensured with the door 12 being closed.

The lower edge portion of the housing opening 14 of the cover 101 of the cover member 142 is a portion through which the laundry is most liable to protrude out of the outer tub 21. If the door 12 is closed with the laundry protruding out of the outer tub 21, the protruding laundry is caught between the door 12 and the packing 120 (the inner projection portion 125 of the third projection 124). Therefore, a part of the packing 120 is not brought into intimate contact with the door 12 around the lower edge portion of the housing opening 14. If ozone is supplied as a laundry decontaminating gas into the outer tub 21, the ozone flows out toward the housing opening 14 through a gap between the door 12 and the packing 120 at which the laundry is caught (as indicated by a broken-line arrow X in FIG. 9). Since the packing 120 is opposed to the housing opening 14 with the space 129 defined between the lower edge portion of the housing opening 14 and the packing 120, the ozone flowing toward the housing opening 14 flows into the space 129 (as indicated by the broken-line arrow X in FIG. 9) to be retained in the housing 11. That is, the ozone is prevented from reaching the housing opening 14 to leak from the housing opening 14 to the outside. The ozone flowing into the space 129 naturally dies out in the housing 11.

Where a greater proportion of the laundry protrudes through the housing opening 14, for example, it is impossible to close the door 12. In this case, a user eliminates the protrusion of the laundry to prevent the laundry from being caught between the door 12 and the packing 120. Further, a sensor for detecting the opening/closing state of the door 12, for example, may be provided. In this case, when a door unclosed state is detected by the sensor, the user is notified of the door unclosed state, and the operation of the washing machine is interrupted until the user eliminates the protrusion of the laundry.

Where a smaller proportion of the laundry protrudes such as to permit the closing of the door 12 or such as not to be detected by the sensor, however, it is difficult for the user to recognize the protrusion of the laundry. Even if the laundry is inevitably caught between the door 12 and the packing 120, the provision of the space 129 prevents the leak of the ozone which may otherwise occur due to the caught laundry.

As described above, the door 12 has the door guide portion 133 extending toward the space 129. Even if the ozone flows toward the housing opening 14 from the outer tub 21 when the laundry protruding through the lower edge portion of the housing opening 14 is caught between the door 12 and the packing 120, the ozone is guided by the door guide portion 133 to be deflected to smoothly flow toward the space 129. This reliably prevents the ozone from reaching the housing opening 14 to leak to the outside through the housing opening 14.

With the door being closed, the engagement portion 106 of the frame 103 of the door 12 (see FIG. 5) is engaged with the engagement portion 111 of the cover 101 of the cover member 142 (see FIG. 7), whereby the door 12 is maintained in the closed state. Further, the door projections 107 on the frame 103 of the door 12 are engaged with the corresponding cover recesses 113 on the cover 101, and the cover projections 112 on the cover 101 are engagement with the corresponding door recesses 134 on the frame 103 of the door 12.

Where the laundry protrudes to the front lower edge portion of the housing opening 14 (see FIG. 7) from the outer tub 21, the protruding laundry is present between the cover projections 112 and the door recesses 134 and between the cover recesses 113 and the door projections 107. This prevents complete engagement between the door recesses 134 and the cover projections 112 and between the door projections 107 and the cover recesses 113, making it impossible to close the door 12. This causes the user to recognize the protrusion of the laundry, and prompts the user to eliminate the protrusion. Thus, the laundry is prevented from being caught between the door 12 and the cover 101 of the cover member 142. Therefore, the ozone is prevented from leaking to the outside.

Modification 1

Figure 11:
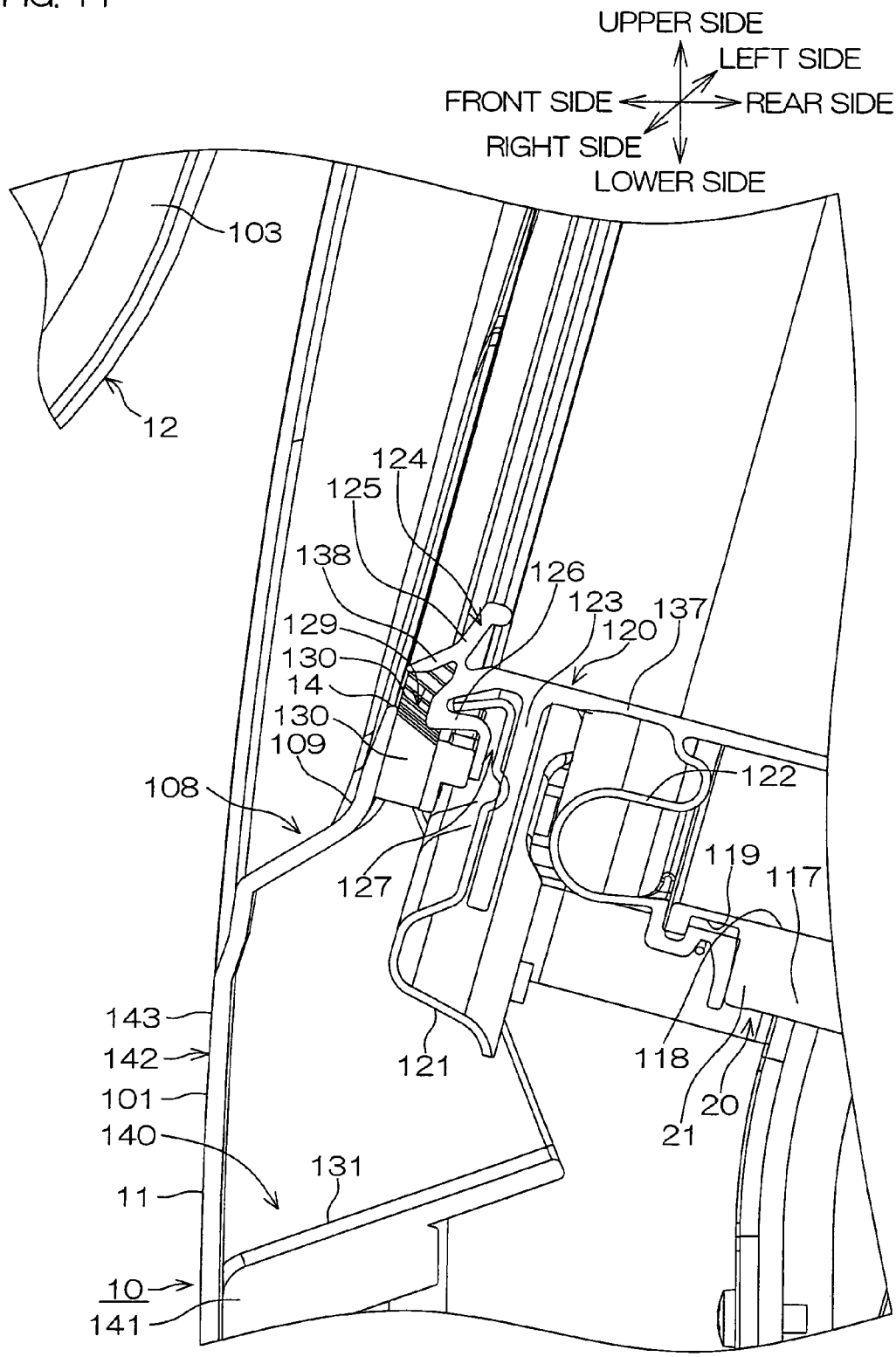
FIG. 11 is a diagram illustrating Modification 1 of the arrangement shown in FIG. 8.
Figure 12:
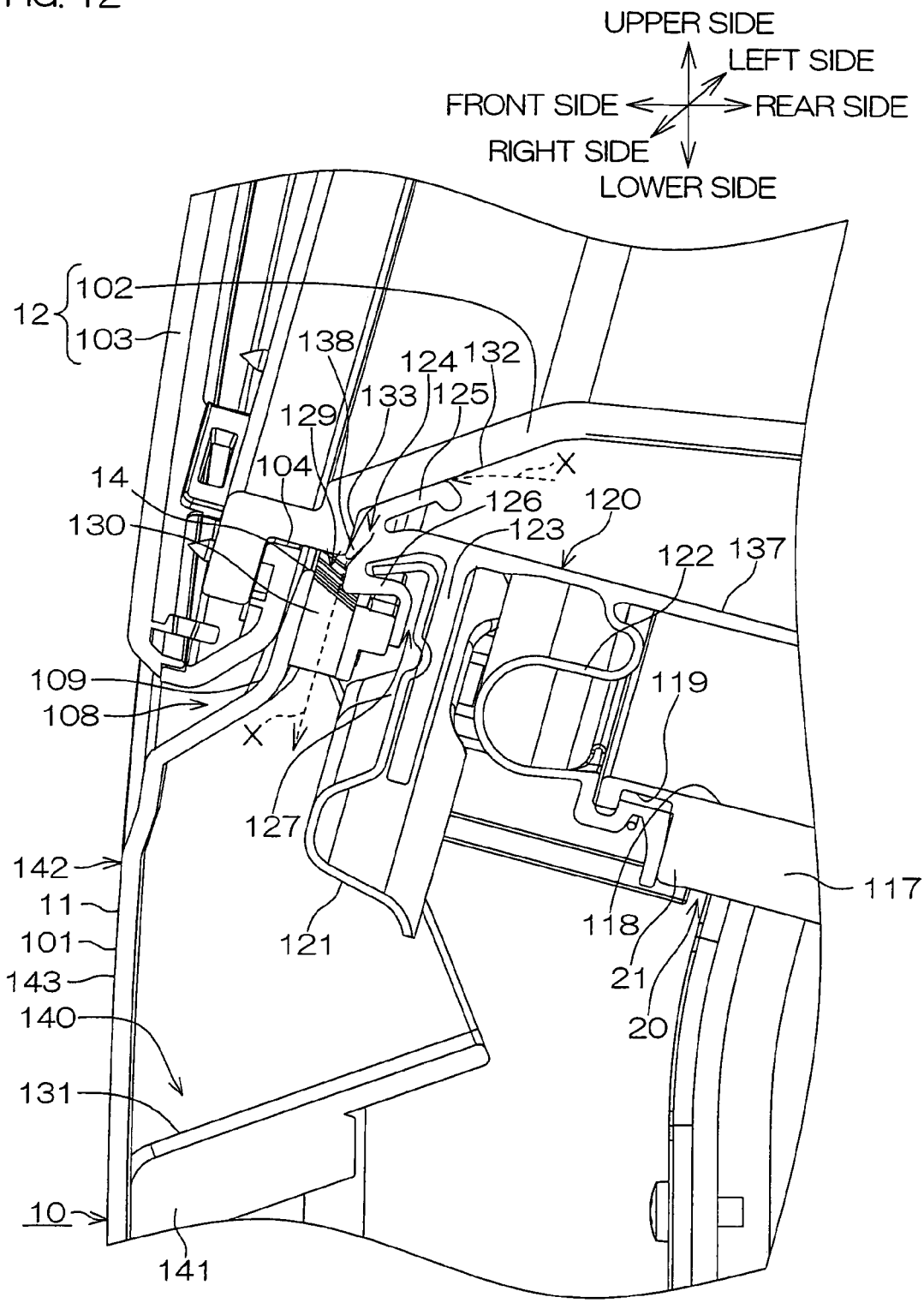
FIG. 12 is a diagram illustrating Modification 1 of the arrangement shown in FIG. 9.

FIG. 11 is a diagram illustrating Modification 1 of the arrangement shown in FIG. 8, and FIG. 12 is a diagram illustrating Modification 1 of the arrangement shown in FIG. 9.

In Modification 1, as shown in FIG. 11, a shutter portion 138 is provided integrally with the front portion of the inner projection portion 125 of the third projection 124 of the packing 120 as being inclined radially outward and forward of the packing 120. The shutter portion 138 is at least located in association with the space 129.

With the door 12 being opened, the shutter portion 138 covers the space 129 from the upper side. This improves the appearance of the periphery of the housing opening 14.

With the door 12 being closed, on the other hand, the shutter portion 138 is pushed rearward by the door guide portion 133 of the glass portion 102 of the door 12, whereby the space 129 is exposed to the upper side. As in the embodiment described above, the ozone is caused to flow into the space 129 (as indicated by a broken-line arrow X in FIG. 12) to be thereby prevented from leaking to the outside.

Modification 2

Figure 13:
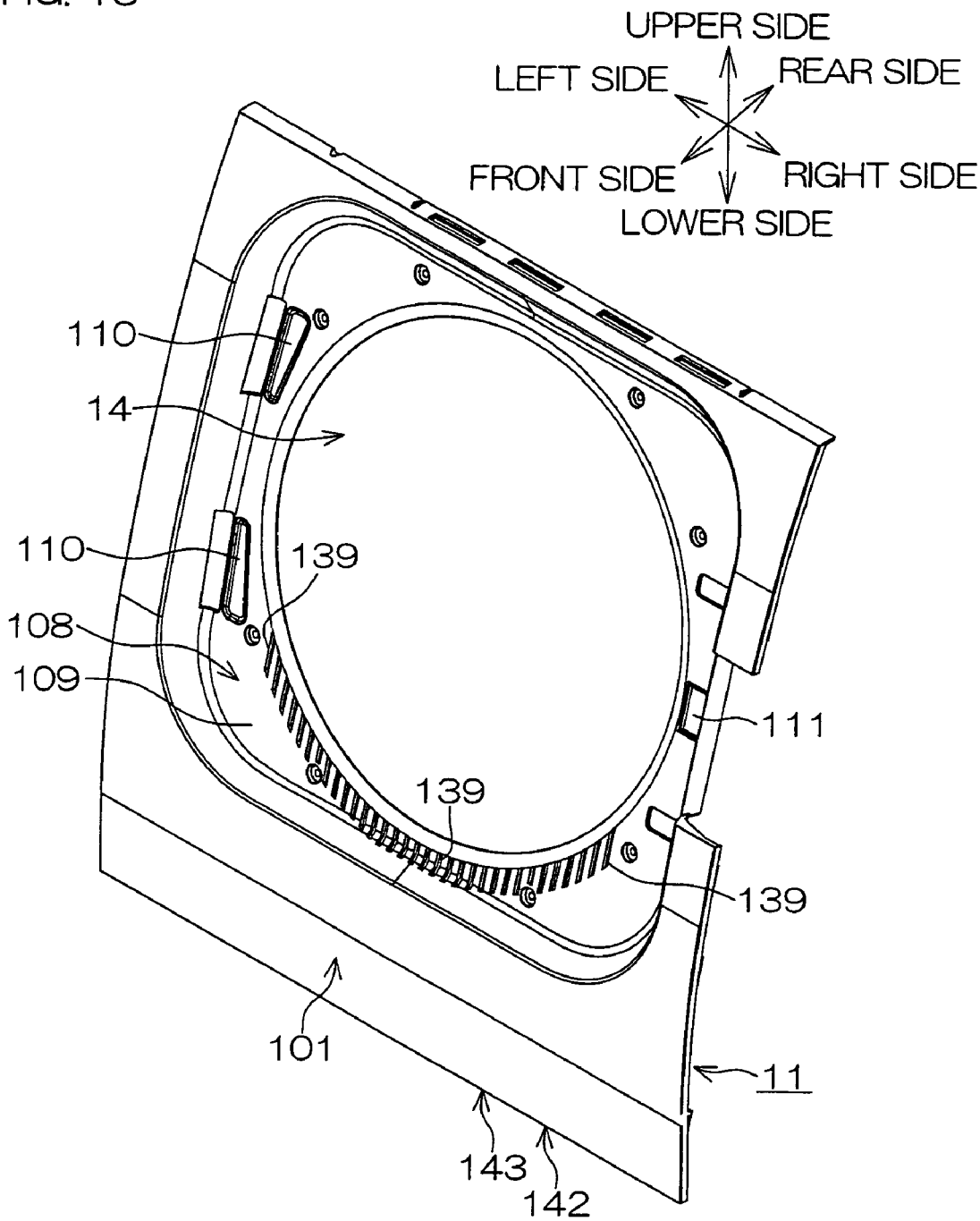
FIG. 13 is a diagram illustrating Modification 2 of the arrangement shown in FIG. 7.
Figure 14:
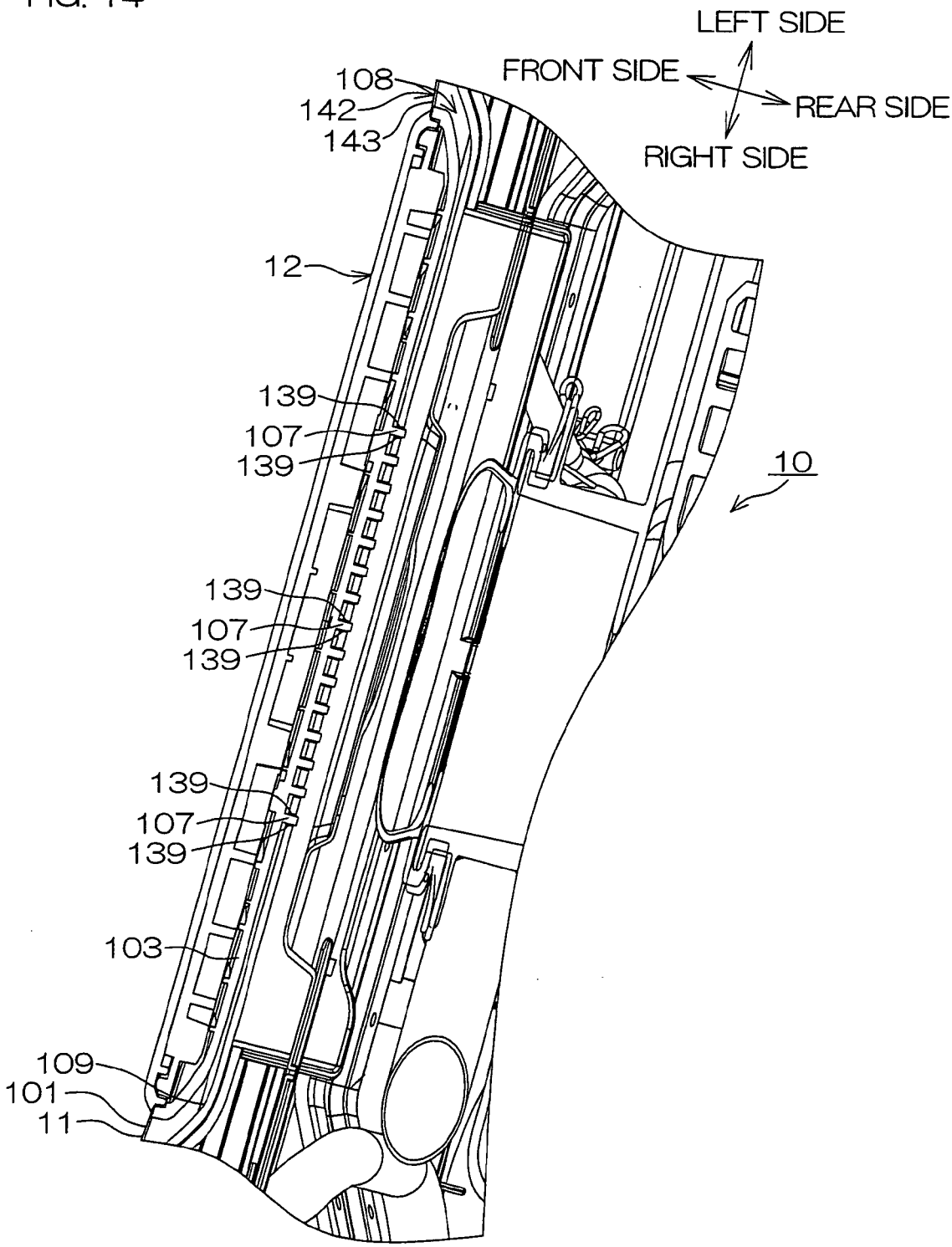
FIG. 14 is a diagram illustrating Modification 2 of the arrangement shown in FIG. 10.

FIG. 13 is a diagram illustrating Modification 2 of the arrangement shown in FIG. 7. FIG. 14 is a diagram illustrating Modification 2 of the arrangement shown in FIG. 10.

Although the cover projections 112 and the cover recesses 113 are provided on the cover 101 of the cover member 142 (see FIG. 7) in the embodiment described above, cover slots 139 may be provided as the first engagement portion instead of the cover recesses 113 of the cover 101. The cover slots 139 are dimensioned such as to receive the door projections 107 on the door 12 (see FIG. 5). Therefore, the door projections 107 on the door 12 are engaged with the corresponding cover slits 139 of the cover 101, as shown in FIG. 14, with the door 12 being closed.

The present invention is not limited to the embodiment described above, but various modifications may be made within the scope of the present invention defined by the appended claims.

This Application corresponds to Japanese Patent Application Ser. No. 2007-015361 filed on Jan. 25, 2007 with the Japan Patent Office, the disclosure of which is incorporated herein by reference.

What is claimed is:

1. An electric washing machine comprising:

a housing;

a cover member defining a front wall of the housing and having an access opening through which laundry is loaded and unloaded into and out of the housing;

a laundry containing tub disposed in the housing and having a tub opening provided in association with the access opening so that the laundry is loaded therein through the access opening and the tub opening to be contained therein;

a door which opens and closes the access opening and the tub opening; and a packing which covers a peripheral edge of the tub opening and is brought into intimate contact with the door for sealing a gap defined between the door and the peripheral edge of the tub opening when the door is closed, the packing being opposed to the access opening with a space defined between a lower edge portion of the access opening and the packing wherein the packing has a shutter portion which cover the space when the door is opened, and uncovers the space when the door is closed.

2. The electric washing machine according to claim 1, wherein the cover member has a plurality of ribs provided adjacent the lower edge portion of the access opening thereof as extending downward and arranged at intervals along the space defined between the packing and the lower edge portion of the access opening.

3. The electric washing machine according to claim 2, wherein the door has a guide wall extending toward the space.

4. The electric washing machine according to claim 3, further comprising an inclined wall disposed below the space and inclined forwardly downward to be connected to the cover member.

5. The electric washing machine according to claim 2, further comprising an inclined wall disposed below the space and inclined forwardly downward to be connected to the cover member.

6. The electric washing machine according to claim 1, wherein the door has a guide wall extending toward the space.

7. The electric washing machine according to claim 6, further comprising an inclined wall disposed below the space and inclined forwardly downward to be connected to the cover member.

8. The electric washing machine according to claim 1, further comprising an inclined wall disposed below the space and inclined forwardly downward to be connected to the cover member.

9. An electric washing machine comprising:

a housing;

a cover member defining a front wall of the housing and having an access opening through which laundry is loaded and unloaded into and out of the housing;

a laundry containing tub disposed in the housing and having a tub opening provided in association with the access opening so that the laundry is loaded therein through the access opening and the tub opening to be contained therein; wherein a packing has a shutter portion which cover the space when the door is opened, and uncovers the space when the door is closed;

a door which opens and closes the access opening and the tub opening;

wherein the cover member has a first engagement portion provided adjacent a lower edge portion of the access opening;

wherein the door has a second engagement portion to be engaged with the first engagement portion when the door is closed.

* * * * *